US011053958B2

(12) United States Patent
Ferraz, Jr. et al.

(10) Patent No.: US 11,053,958 B2
(45) Date of Patent: Jul. 6, 2021

(54) REGENERATION VALVE FOR A HYDRAULIC CIRCUIT

(71) Applicant: Caterpillar Inc., Deerfield, IL (US)

(72) Inventors: John Ferraz, Jr., Romeoville, IL (US); Michael Thomas Jackson, Hanna City, IL (US); William Norbert O'Neill, Eureka, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 16/357,459

(22) Filed: Mar. 19, 2019

(65) Prior Publication Data

US 2020/0299932 A1 Sep. 24, 2020

(51) Int. Cl.

| | |
|---|---|
| ***F15B 13/02*** | (2006.01) |
| ***F15B 21/14*** | (2006.01) |
| ***F15B 11/024*** | (2006.01) |
| ***F15B 13/04*** | (2006.01) |
| ***E02F 9/22*** | (2006.01) |

(52) U.S. Cl.

CPC ..... *F15B 13/021* (2013.01); *E02F 9/2217* (2013.01); *F15B 11/024* (2013.01); *F15B 13/0403* (2013.01); *F15B 21/14* (2013.01); *F15B 2011/0243* (2013.01); *F15B 2211/3058* (2013.01); *F15B 2211/88* (2013.01)

(58) Field of Classification Search

CPC .. F15B 11/024; F15B 13/021; F15B 13/0403; F15B 2011/0243; F15B 2211/3058

USPC ..... 91/436

See application file for complete search history.

(56) References Cited

U.S. PATENT DOCUMENTS

| | | | | |
|---|---|---|---|---|
| 3,604,313 | A * | 9/1971 | Fruehauf | E02F 9/2203 91/438 |
| 4,434,708 | A | 3/1984 | Bowden | |
| 5,014,734 | A * | 5/1991 | Smith | F15B 11/024 137/115.09 |
| 5,746,109 | A | 5/1998 | Matsuda | |
| 5,907,991 | A | 6/1999 | Ramamoorthy et al. | |
| 5,960,695 | A | 10/1999 | Aardema et al. | |
| 6,699,311 | B2 * | 3/2004 | Smith | E02F 3/844 91/436 |
| 6,877,417 | B2 | 4/2005 | Shimada | |
| 9,127,437 | B2 | 9/2015 | Hand et al. | |
| 9,341,198 | B2 | 5/2016 | Nakamura et al. | |
| 2003/0121410 | A1 | 7/2003 | Smith et al. | |

(Continued)

*Primary Examiner* — Thomas E Lazo
*Assistant Examiner* — Michael Quandt
(74) *Attorney, Agent, or Firm* — Xsensus LLC

(57) ABSTRACT

A regeneration valve includes a housing defining a first port, a second port, a third port, and a chamber fluidly communicating with the first, second, and third ports. The chamber has a valve element movable between a first position, in which the second port fluidly communicates with the first port, and a second position, in which the second port fluidly communicates with the third port. A resilient member biases the valve element towards the first position. In operation, a flow restrictor element moves between the first port and the second port for restricting fluid flow from the second port to the first port. At a predetermined flow rate between the second port and the first port, if a supply pressure of fluid at the actuation chamber exceeds the bias of the resilient member, the valve element moves to the second position for fluidly communicating the second and third ports.

20 Claims, 5 Drawing Sheets

(56) References Cited

U.S. PATENT DOCUMENTS

| | | | |
|---|---|---|---|
| 2013/0287601 | A1 | 10/2013 | Mori et al. |
| 2014/0026546 | A1 | 1/2014 | Bacon et al. |

* cited by examiner

REGENERATION VALVE FOR A HYDRAULIC CIRCUIT

TECHNICAL FIELD

The present disclosure relates to valves and, more particularly, to regeneration valves used in hydraulic circuits to direct discharged fluid from a rod end of a cylinder to a cap end of the cylinder.

BACKGROUND

A double-acting hydraulic cylinder typically includes a piston that is disposed in a cylinder chamber to define a cap end and a rod end. A pump may be provided for delivering pressurized hydraulic fluid to the cylinder, and a reservoir may receive hydraulic fluid that is discharged from the cylinder. An implement control valve controls fluid communication of the cap and rod ends of the cylinder with the pump and reservoir. For example, when the cylinder is to be retracted, the implement control valve may move to a cylinder retract position in which the rod end of the cylinder fluidly communicates with the pump and the cap end of the cylinder fluidly communicates with the reservoir. In this retract configuration, the rod end is at a higher pressure and the cap end is at a lower pressure, so that the piston moves toward the cap end. Alternatively, when the cylinder is to be extended, the implement control valve may move to a cylinder extend position in which the rod end fluidly communicates with the reservoir and the cap end fluidly communicates with the pump. In this extend configuration, the rod end is at a lower pressure and the cap end is at a higher pressure, so that the piston moves toward the rod end.

In some cases, the cylinder may extend or retract without any pump pressure when there is external loading on the cylinder. For instance, if the cylinder is configured to moveably support a work implement on a frame of a machine, for example, a blade of a track type tractor, and when gravity acts on the blade, the cylinder may extend to cause a lowering of the blade. During such extension of the cylinder, fluid pressure at the rod end of the cylinder may be higher than fluid pressure at the cap end of the cylinder i.e., the cap end pressure may be negative.

Regeneration valves are generally known for use in hydraulic circuits to route hydraulic fluid between the cap end and the rod end of the cylinder under certain operating conditions. In a track type tractor, for example, a regeneration valve may be used in a blade lift circuit to increase the rate at which the blade is lowered under the force of gravity, also known as a quick drop movement. When the blade is to be lowered, the implement control valve is placed in the cylinder extend position so that the rod end fluidly communicates with the reservoir and the cap end fluidly communicates with the pump. The regeneration valve is configured to divert a portion of the hydraulic fluid exiting the rod end to the cap end instead of back to the reservoir. This regenerative flow is combined with incoming flow from the pump to provide an increased flow rate to the cap end of the cylinder. This increased flow rate may increase the rate at which the cylinder extends.

Additionally, the increased flow rate may prevent, or at least reduce, cavitation in the cap end. When the blade is dropped under the force of gravity, the piston rapidly moves toward the rod end. Rapid movement of the piston towards the rod end may exceed the pump capacity to deliver fluid to the cap end, thereby creating a void or cavitation in the cap end of the cylinder. The increased flow rate of fluid to the cap end that is provided by the regeneration valve helps to prevent, or at least reduce, such a void.

The foregoing is disclosed in the U.S. Publication 2014/0026546. Nevertheless, increased demands of functionality from a work implement, for example, an increase in the rate at which the cylinder extends to accomplish the quick drop movement of the blade, is motivating manufacturers of earthmoving machines to pursue development of regeneration valves so that the regeneration valves produced are capable of fulfilling such increased demands of functionality from the work implement.

SUMMARY OF THE DISCLOSURE

In accordance with one aspect of the disclosure, a regeneration valve is provided for a hydraulic circuit having a hydraulic fluid flowing therethrough. The regeneration valve may include a housing defining a first port, a second port, a third port, and a chamber formed in the housing to fluidly communicate with the first, second, and third ports. A valve element may be disposed in the chamber and movable between a first position, in which the second port fluidly communicates with the first port, and a second position, in which the second port fluidly communicates with the third port. A resilient member may be coupled to the valve element and configured to apply a biasing force on the valve element toward the first position. A moveable flow restrictor element is disposed between the valve element and the housing. The flow restrictor element is configured to move between the first port and the second port of the housing for restricting flow of hydraulic fluid from the second port to the first port. An actuation chamber is located at an end of the valve element and in a direction opposite to the resilient member. The actuation chamber is disposed in selective fluid communication with the second port via a pilot passageway defined in the housing. During operation, upon restricting flow of fluid from the second port to the first port by the flow restrictor element and at a predetermined flow rate of hydraulic fluid from the second port to the first port, if a supply pressure of hydraulic fluid at the actuation chamber exceeds the biasing force of the resilient member, the valve element moves to the second position for supplying fluid from the second port to the third port.

In another aspect of the disclosure, a hydraulic circuit for a machine implement may be provided that includes a pressurized hydraulic fluid source, a fluid reservoir, and a hydraulic cylinder having a cylinder cap end and a cylinder rod end. A regeneration valve may include a housing defining a first port fluidly communicating with the fluid reservoir, a second port fluidly communicating with one of the cylinder cap end and the cylinder rod end, and a third port fluidly communicating with both the pressurized fluid source and a remaining one of the cylinder cap end and the cylinder rod end. A chamber may be formed in the housing and fluidly communicates with the first, second, and third ports, and a valve element may be disposed in the chamber and movable between a first position, in which the second port fluidly communicates with the first port, and a second position, in which the second port fluidly communicates with the third port. A resilient member may be coupled to the valve element and configured to apply a biasing force on the valve element toward the first position. A moveable flow restrictor element is disposed between the valve element and the housing. The flow restrictor element is configured to move between the first port and the second port of the housing for restricting flow of hydraulic fluid from the second port to the first port. An actuation chamber is located at an end of the valve element and in a direction opposite to the resilient member. The actuation chamber is disposed in selective fluid communication with the second port via a pilot passageway defined in the housing. During operation, upon restricting flow of fluid from the second port to the first port by the flow restrictor element and at a predetermined flow rate of hydraulic fluid from the second port to the first port, if a supply pressure of hydraulic fluid at the actuation chamber exceeds the biasing force of the resilient member, the valve element moves to the second position for supplying fluid from the second port to the third port.

Other features and aspects of this disclosure will be apparent from the following description and the accompanying drawings.

DETAILED DESCRIPTION

Figure 1:
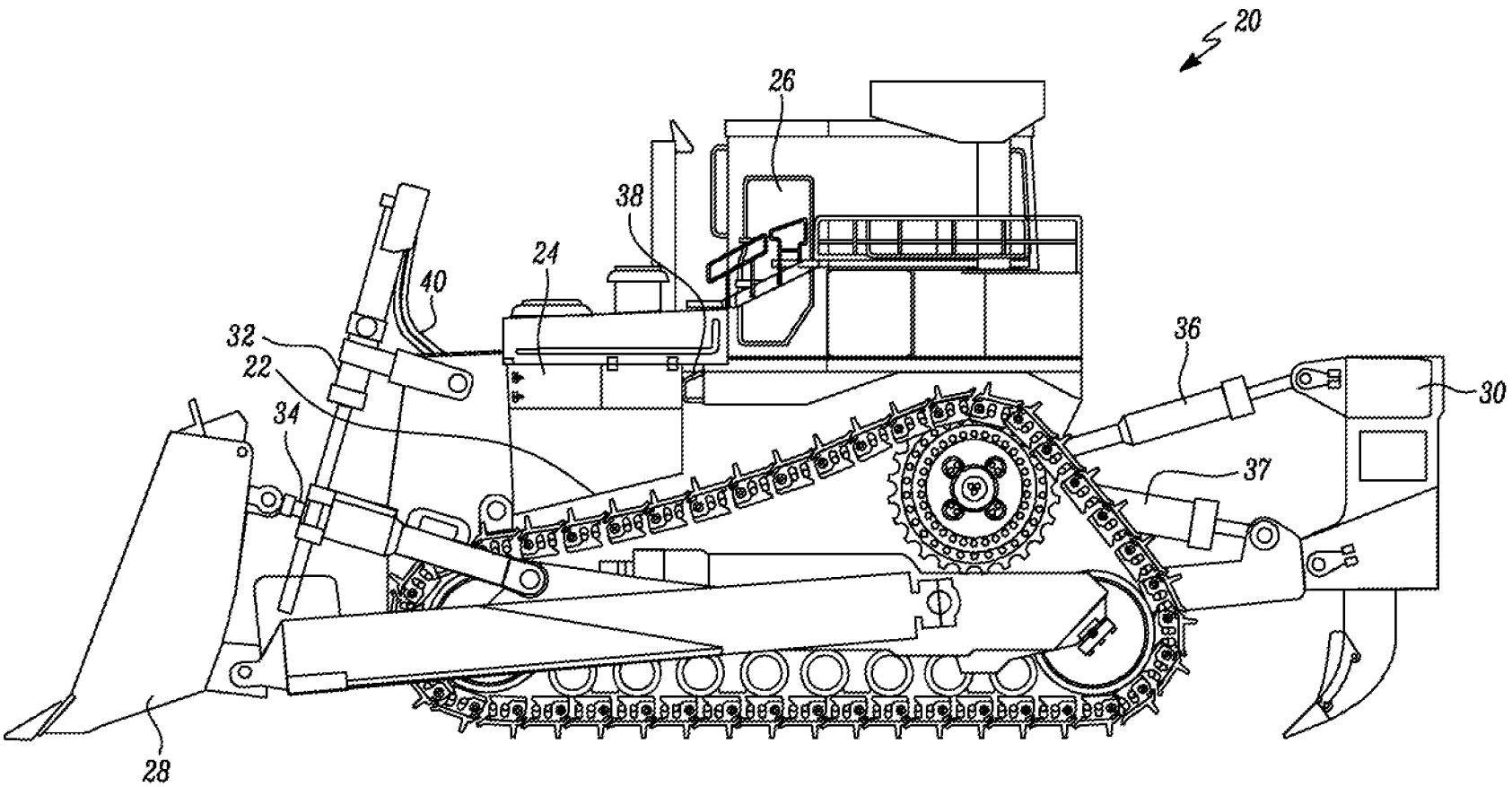
FIG. 1 is a side elevational view of an exemplary tractor, in accordance with embodiments of the present disclosure.

A regeneration valve is provided for redirecting hydraulic fluid from a cylinder rod end to a cylinder cap end during rapid extension of the cylinder rod. The regeneration valve may include a flow restrictor element that is responsive to a rate of fluid flow through the valve for automatically actuating a valve element of the regeneration valve from a first position, in which the cylinder rod end fluidly communicates with a fluid reservoir, to a second or regeneration position, in which the cylinder rod end fluidly communicates with the cylinder cap end.

Explanation will now be made in reference to the accompanying drawings. Reference numerals appearing in more than one figure indicate the same or corresponding parts in each of them.

Referring to FIG. 1, a track-type tractor constructed according to the present disclosure is generally referred to by reference numeral 20, While this disclosure is provided with primary reference to a track-type tractor, it will be understood that the teachings of this disclosure may be employed with equal efficacy in conjunction with other machines, such as loaders, excavators, and pipelayers. Still further, the machine may have any type of track, wheel, or other ground engaging member used for transportation.

In the illustrated embodiment, the track-type tractor 20 may include a chassis 22 supporting an engine 24. An operator cab or seat 26 also may be supported by the chassis 22 behind the engine 24. In some embodiments, the track-type tractor 20 may be remotely controlled. Various tools or implements may be mounted on the tractor 20, such as, but not limited to, a blade 28 and a ripper 30. Hydraulic cylinders may be used to lift or otherwise move the tools and implements. For example, a pair of lift cylinders 32 (only one shown in FIG. 1 and a tilt cylinder 34 may be provided to manipulate the blade 28. Similarly, a ripper tilt cylinder 36 and a ripper lift cylinder 37 may be provided to manipulate i.e., tilt and lift the ripper 30 relative to the chassis 22. A hydraulic pump 38 may be operatively coupled to the engine 24 to provide pressurized hydraulic fluid via hoses 40 to hydraulic cylinders 32, 34, 36, and 37.

Figure 2:
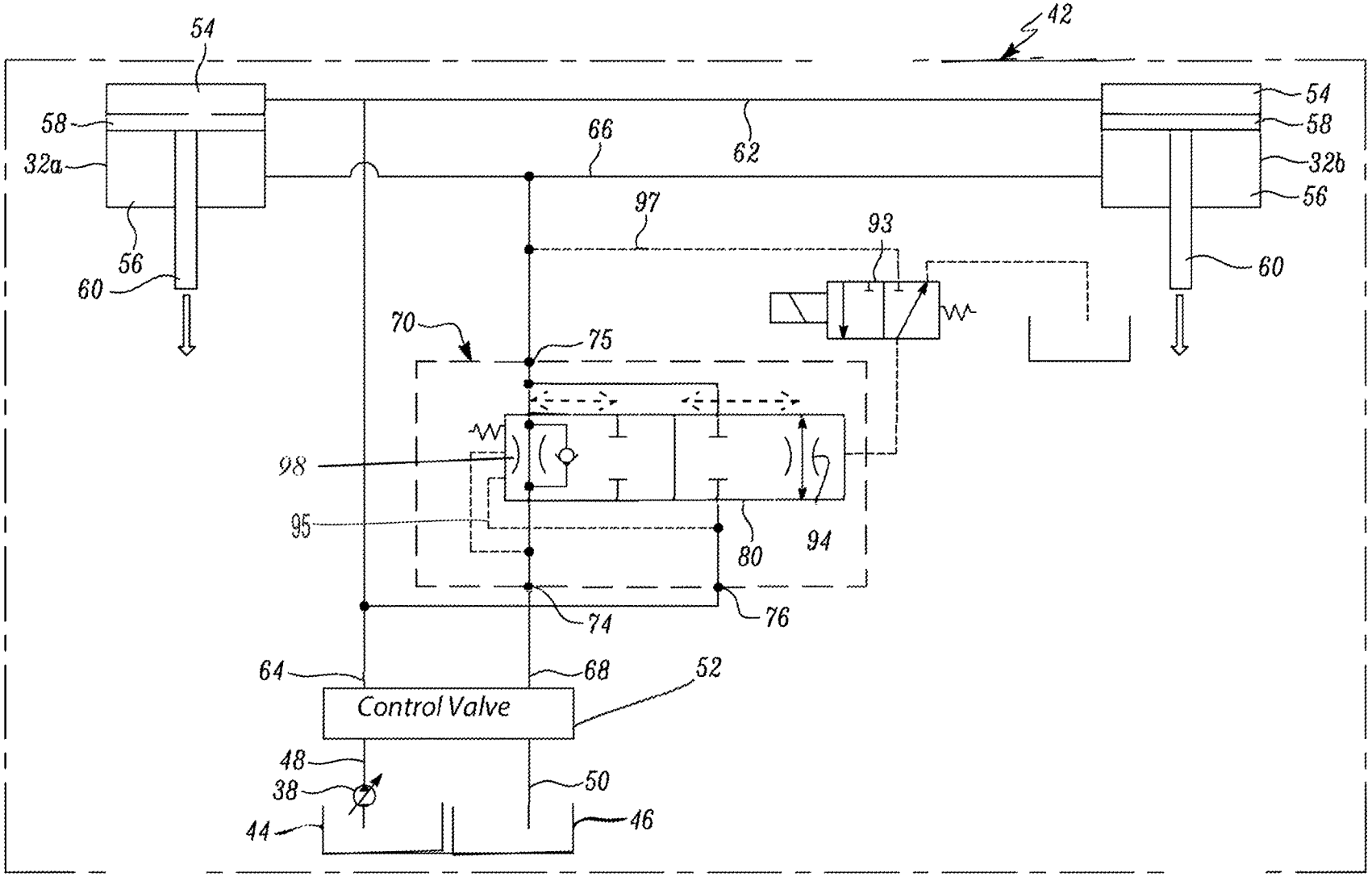
FIG. 2 is a schematic of a hydraulic fluid circuit having a regeneration valve that may be employed by the tractor of FIG. 1, in accordance with an embodiment of the present disclosure.

Referring to FIG. 2, the tractor 20 may include a hydraulic circuit 42 for operating one or more of the hydraulic cylinders. The hydraulic circuit 42 may include a pressurized hydraulic fluid source, which may be the hydraulic pump 38. The hydraulic pump 38 may include an inlet for drawing hydraulic fluid from a fluid source 44 and an outlet for delivering pressurized hydraulic fluid to the circuit 42. A fluid reservoir 46, which may be provided at substantially atmospheric pressure, may receive hydraulic fluid from the circuit 42.

A pump conduit 48 and a reservoir conduit 50 may fluidly couple the pump 38 and the reservoir 46 to a directional control valve 52. The control valve 52 may selectively control fluid communication from the pump 38 and the reservoir 46 to one or more hydraulic mechanisms actuated by the hydraulic circuit 42. For example, the control valve 52 may be a four-position, four-way valve of conventional design that includes a position for each of: (1) a raising blade operation; (2) a holding blade operation; (3) a controlled lowering blade operation; and (4) a floating blade operation. Alternatively, the control valve 52 may have any other configuration, including a single valve or multiple valves. Additionally, the control valve 52 may be pilot actuated, electrically actuated, or mechanically actuated.

Referring to FIGS. 1 and 2, the hydraulic circuit 42 may further include hydraulic mechanisms, such as the first and second lift cylinders 32*a*, 32*b* that are operably coupled to the blade 28. Each of the lift cylinders 32*a*, 32*b* may be a double acting cylinder that includes a cap end 54, a rod end 56, a piston 58 slidably disposed therein, and a piston rod 60 coupling the piston 58 to the blade 28. The blade 28 may be acted on by gravity such that the weight of the blade 28 establishes a generally downwardly dropping direction tending to extend the lift cylinders 32*a*, 32*b*. A first conduit 62 may fluidly communicate between the cap ends 54 of the cylinders 32*a*, 32*b* and a first outlet 64 of the control valve 52, while a second conduit 66 may fluidly communicate between the rod ends 56 and a second outlet 68 of the control valve 52.

In operation, the control valve 52 may be actuated to deliver pressurized hydraulic fluid from the pump 38 to ends of the lift cylinders 32*a*, 32*b* that are selected according to a desired blade operation. For example, if the blade is to be raised, the control valve 52 may be moved to a position in which pressurized hydraulic fluid is directed to the rod ends 56 and the cap ends 54 may be placed in fluid communication with the reservoir 46, so that the pistons 58 will move upwardly to raise the blade 28. Conversely, to lower the blade 28, the control valve 52 may move to a position in Which pressurized hydraulic fluid is directed to the cap ends 54 while the rod ends 56 fluidly communicate with the reservoir 46, so that the pistons 58 move downwardly to lower the blade 28.

A regeneration valve 70 may be provided to assist with rapid movement of the pistons 58 toward the rod ends 56. In the illustrated embodiment, movement of the pistons 58 toward the rod ends 56 may extend the lift cylinders 32*a*, 32*b*, while in an alternative configuration the lift cylinders 32*a*, 32*b* may retract. Returning to the exemplary embodiment, certain blade lowering operations may use the force of gravity on the blade to execute a quick drop, which may cause the pistons 58 to move rapidly in the downward direction. The rapid downward movement of the pistons 58 may cavitate the cap ends 54 of the cylinders 32*a*, 32*b*, such that the cap ends 54 are not completely filled with hydraulic fluid. Since the cavitated cap ends 54 of the cylinders 32*a*, 32*b* must be filled with fluid from the pump 38 after the blade 28 comes to rest (typically once it hits the ground), a considerable lag time occurs before sufficient downward force can be applied to the blade 28 for penetrating the ground. The regeneration valve 70 may be configured to divert at least a portion of the fluid in the rod ends 56, that would normally flow to the reservoir 46, to the cap ends 54 thereby minimizing cavitation and resulting lag time.

Figure 3:
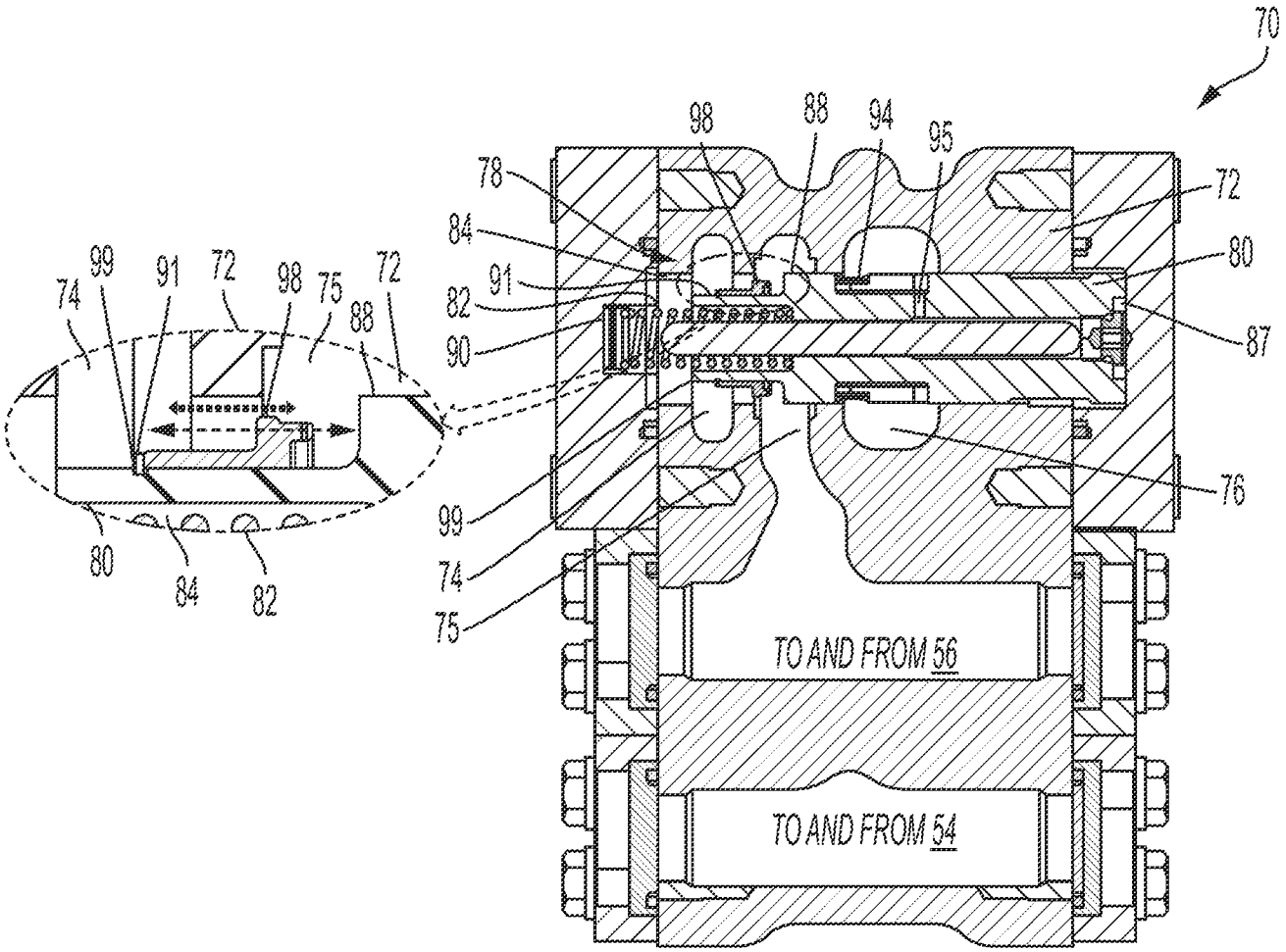
FIGS. 3 and 4 are different cross-sectional views of the regeneration valve of FIG. 2 showing a valve element in a first position and a second position respectively, in accordance with embodiments of the present disclosure, wherein FIG. 3 can be viewed in terms of a cross-sectional view along a vertical plane and FIG. 4 can be viewed in terms of a cross-sectional view along a horizontal plane that orthogonally bisects the vertical plane.
Figure 4:
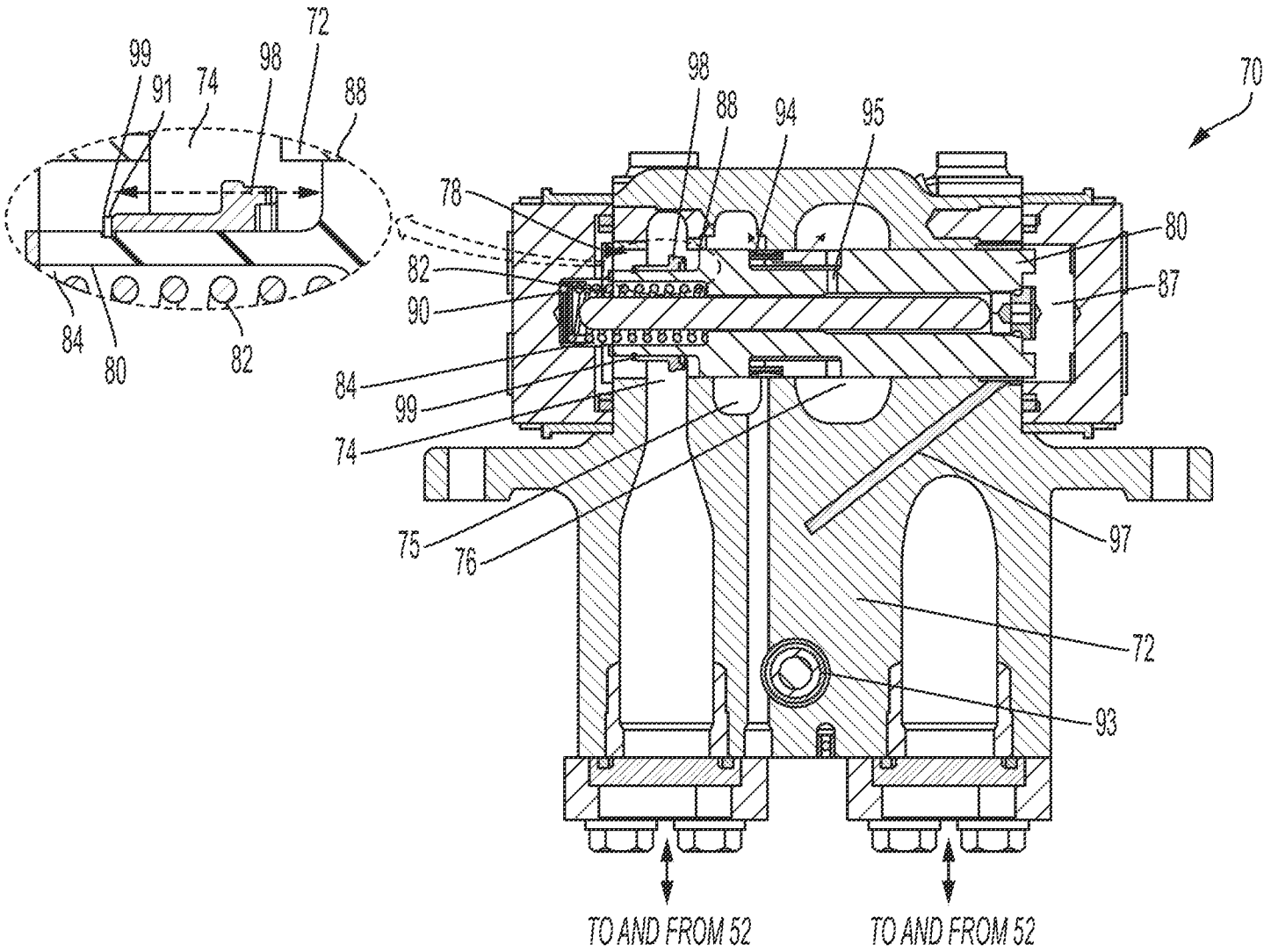

With continued reference to FIG. 2, and as best shown in FIGS. 3 and 4, the regeneration valve 70 may include a housing 72 defining a first port 74 fluidly communicating with the control valve 52 i.e., with the second outlet 68 of the control valve 52, a second port 75 fluidly communicating with the cylinder rod ends 56, and a third port 76 fluidly communicating with the cylinder cap ends 54. A chamber 78 may be formed in the housing 72 and may fluidly communicate with the first, second, and third ports 74, 75, and 76.

A valve element 80 is disposed in the chamber 78 and movable between a first position as shown in FIGS. 2 and 3, in which the valve element 80 allows the second port 75 to fluidly communicate with the first port 74, and a second (or regenerative) position as shown in FIG. 4, in which the valve element 75 allows the second port 75 to fluidly communicate with the third port 76 while the valve element 80 restricts fluid flow from the second port 75 to the first port 74. A resilient member 82 may be operably coupled to the valve element 80 and configured to apply a biasing force on the valve element 80 toward the first position. In the exemplary embodiment, the resilient member 82 may be formed as a spring and disposed within a resilient member chamber 84 of the housing 72. As shown, the resilient member chamber 84 may also be disposed in fluid communication with the control valve 52 via the first port 74. A signal pressure passageway 95, which can be in fluid communication with the third port 76 and the cap ends 54 of the cylinders 32*a*, 32*b* such as shown in FIG. 2, can provide signal pressure to the flow restrictor element 98.

Figure 5:
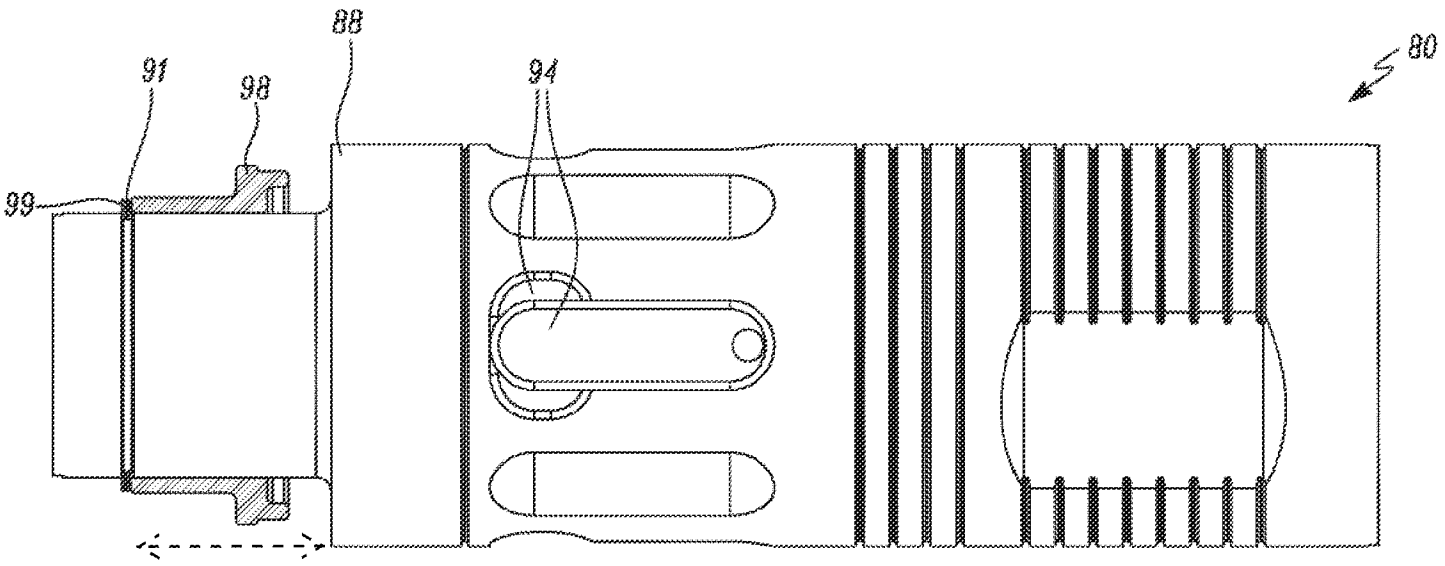
FIG. 5 is an enlarged side view of the valve element showing a groove, a flow slot, and a flow restrictor element and a retaining ring in section, in accordance with an embodiment of the present disclosure, wherein the left portion is a side cross-sectional view of the valve element.

A moveable flow restrictor element 98 is disposed between the valve element 80 and the housing 72. In an embodiment as best shown in the view of FIG. 5, the valve element 80 may be configured to define a groove 91 thereon. A retaining ring 99 is disposed in the groove 91 and helps to retain a position of the flow restrictor element 98 on the valve element 80. As shown in the illustrated embodiment of FIGS. 3-5, the flow restrictor element 98 is shaped as a sleeve and disposed about the valve element 80 i.e., between a land 88 of the valve element 80 and the retaining ring 99. When influenced by fluid flow in the chamber 78, the flow restrictor element 98 may move to co-operate with the retaining ring 99 that is disposed in the groove 91 of the valve element 80 for accomplishing movement of the valve element 80 in relation to the housing 72, explanation to which will be made later herein.

An actuation chamber 87 is located at an end of the valve element 80 and disposed in a direction opposite to the resilient member chamber 84. The actuation chamber 87 may fluidly communicate with a dedicated pilot pump (not shown), the hydraulic pump 38, or any other source of pressurized hydraulic fluid to facilitate movement of the valve element 80 within the chamber 78. The actuation chamber 87 is also disposed in selective fluid communication with the second port 75 via a pilot passageway 97 defined in the housing 72.

In operation, the flow restrictor element 98 is responsive to a rate of fluid flow through the chamber 78, more specifically, between the first and second polls 74, 75 of the housing 72. The flow restrictor element 98 provides minimal restriction for flow of fluid from the first port 74 to the second port 75 when this fluid flow tends to move the flow restrictor element 98 to abut with the land 88 of the valve element 80. However, the flow restrictor element 98 provides a greater restriction for flow of fluid from the second port 75 to the first port 74 in response to which the flow restrictor element 98 moves to abut with the retaining ring 99 (as shown in the view of FIG. 3). Therefore, it may be noted that in embodiments herein, at a predetermined flow rate of hydraulic fluid from the second port 75 to the first port 74, the flow restrictor element 98 causes a pressure differential to occur between the second port 75 and the first port 74, which in turn, causes the high-pressure and high-flow rate fluid from the second port 75 to be communicated to the actuation chamber 87, or stated differently, at least a pilot pressure of fluid from the second port 75 is transmitted through the pilot passageway 97 to the actuation chamber 87. When the supply pressure in the actuation chamber 87 overcomes i.e., is greater than the biasing force of the resilient member 82 in the resilient member chamber 84, the valve element 80 moves from a position as shown in FIG. 3 to a position as shown in FIG. 4.

The predetermined flow rate of hydraulic fluid, disclosed herein, may be a minimum or threshold flow rate of the hydraulic fluid flowing from the second port 75 to the first port 74 for the flow restrictor element 98 to create the pressure differential between the actuation chamber 87 and the resilient member chamber 84 for moving the valve element 80 into the second position i.e., for moving the land 88 of the valve element 80 into a position between the first port 74 and the second port 75 of the housing 72.

With continued reference to FIGS. 3-4 and as best shown in the view of FIG. 5. In embodiments herein, a flow slot 94 may be additionally formed in the valve element 80 and oriented to fluidly communicate with the hydraulic fluid flowing through the chamber 78. Particularly, when the valve element is disposed the second position, fluid from the second port 75 is restricted by the land 88 of the valve element 80 from flowing into to the first port 74 and is instead allowed to flow through the flow slot 94 of the valve element 80 to enter the third port 76.

In embodiments herein, it may be noted that the biasing force of the resilient member 82 is adjustable for varying the amounts of restrictions provided by the flow restrictor element 98 to fluid flows between the first and second ports 74, 75. As shown in the illustrated embodiment of FIGS. 3-4, the regeneration valve 70 also includes multiple shims 90 that are positioned within the resilient member chamber 84. Each shim 90 may be of a predetermined width. By varying the number of shims 90 used i.e., positioned within the resilient member chamber 84, the biasing force of the resilient member 82 can be adjusted. Adjustment of the biasing force of the resilient member 82, in turn, helps to vary a timing at which the pressure differential between the actuation chamber 87 and the resilient member chamber 84 overcomes the biasing force of the resilient member 82 for causing the valve element 80 to move from the first position to the second position so that fluid from the second port 75 may be allowed to enter the third port 76. It will be appreciated that such adjustments to the biasing force of the resilient member 82 may be made depending on specific requirements of an application.

Referring again to the schematic of FIG. 2, the pilot passageway 97 may be configured to fluidly communicate between the conduit 66 and a solenoid operated valve 93 such that when fluid is returned from the rod end chambers 56 of the cylinders 32*a* and 32*b*, some portion of the fluid may be routed via the conduit 66 to the solenoid operated valve 93 via the pilot passageway 97. The solenoid operated valve 93 may be actuated, with the help of a control lever position sensor (not shown) and a controller (not shown) that is disposed in independent communication with the control lever position sensor and the solenoid operated valve 93. Actuation of the solenoid operated valve 93 into a suitable operating position may allow fluid from the pilot passageway 97 to actuate the valve element 80 i.e., by increasing the pressure in the actuation chamber 87 and when the supply pressure in the actuation chamber 87 overcomes the biasing force of the resilient member 82, the valve element 80 moves from the first position to the second position in which the valve element 80 is configured to supply fluid from the second port 75 to the third port 76 i.e., from the rod ends 56 to the cap ends 54 of the cylinders 32*a*, 32*b*.

In view of the foregoing alternative embodiment, it should be noted that the present disclosure is not limited to use of hydraulically operated valves alone, for example, the hydraulically operated valve element 80. Rather, a scope of the present disclosure extends to include the use of one or more electrohydraulic components, for example, the solenoid operated valve 93 that may help actuate movement of the valve element 80 from the first position to the second position based on the pressure differential across the valve element 80.

With regard to the alternative embodiment disclosed herein, it may be noted that the controller may be a standalone controller or may be configured to co-operate with an existing electronic control unit (ECU) (not shown) of the machine i.e., the tractor 20. Further, the controller may embody a single microprocessor multiple microprocessors. Numerous commercially available microprocessors can be configured to perform the functions of the controller disclosed herein. It should be appreciated that the controller could readily be embodied in a general machine microprocessor capable of controlling numerous machine functions. The controller may also include a memory and any other components for running an application. Various circuits may be associated with the controller such as power supply circuitry, signal conditioning circuitry, solenoid driver circuitry, and other types of circuitry. Also, various routines, algorithms, and or programs can be stored at the controller for controlling an operation of the valve element 80, via the solenoid operated valve 93, for regeneration of pressurized fluid from the rod ends 56 to the cap ends 54 of the hydraulic cylinders 32*a*, 32*b*.

Various embodiments disclosed herein are to be taken in the illustrative and explanatory sense and should in no way be construed as limiting of the present disclosure. All joinder references (e.g., associated, provided, connected, coupled and the like) are only used to aid the reader's understanding of the present disclosure, and may not create limitations, particularly as to the position, orientation, or use of the control modules, the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", or any other ordinary and/or numerical terms, should also be taken only as identifiers, to assist the reader's understanding of the various elements of the present disclosure, and may not create any limitations, particularly as to the order, or preference, of any element relative to or over another element.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The present disclosure may be applicable to machines having one or more hydraulic circuits that include a regeneration valve for executing a quick drop of an implement. The regeneration valve 70 disclosed herein may include a flow restrictor element 98 that is responsive to a flow rate of fluid from the second port 75 to the first port 74 of the regeneration valve 70 for actuating the valve element 80 from a first position to a second position.

Under normal operating conditions, the regeneration valve 70 may typically be in the first position shown in FIGS. 2 and 3, where the first port 74 fluidly communicates with the second port 75, and the third port 76 is closed. With the regeneration valve 70 in the first position, the lift cylinders 32*a*, 32*b* may execute a controlled extension or a controlled retraction. During controlled extension, the control valve 52 may be actuated to a position in which the pump 38 fluidly communicates with the cap ends 54 and the reservoir 46 fluidly communicates with the rod ends 56. In this configuration, pressurized hydraulic fluid may flow into the cap ends 54, while hydraulic fluid in the rod ends 56 may drain into the reservoir 46, so that the pistons 58 may move downwardly in a controlled fashion. During a controlled retraction, the control valve 52 may be actuated to a different position in which the pump 38 fluidly communicates with the rod ends 56 and the reservoir 46 fluidly communicates with the cap ends 54. In this configuration, pressurized hydraulic fluid may flow into the rod ends 56, while hydraulic fluid in the cap ends 54 may drain into the reservoir, so that the pistons 58 may move upwardly in a controlled fashion. During both controlled extensions and controlled retractions, another pilot passageway (not shown) may communicate hydraulic fluid to the resilient member chamber 84, which may assist the resilient member 82 in holding the valve element 80 in the first position.

Instead, if the operator desires to execute a quick drop by using the weight of the blade 28 to quickly extend the lift cylinders 32*a*, 32*b*, the flow restrictor element 98 of the regeneration valve 70 may actuate movement of the valve element 80 to the second position for generating fluid from the rod ends 56 via the second port 75 to the cap ends 54 via the third port 76 besides preventing, or at least reducing, cavitation and lag from occurring in the cap ends 54 of the cylinders 32*a*, 32*b*. During a quick drop, the weight of the blade 28 may tend to quickly extend the cylinders 32*a*, 32*b* by rapidly pulling the pistons 58 downwardly. The rapid movement of the pistons 58 may push hydraulic fluid in the rod ends 56 through the second conduit 66 and into the second port 75 of the regeneration valve 70.

With the valve element 80 still in the first position, the hydraulic fluid may initially flow from the second port 75 to the first port 74 and on to the reservoir 46. When the rate of fluid flow from the second port 75 to the first poll 74 is equal to or greater than a threshold, the flow restrictor element 98 may automatically and hydro-mechanically move to abut with the retaining ring 99, Upon abutment of the flow restrictor element 98 with the retaining ring 99, the pressure differential across the valve element i.e., the difference in pressures between the actuation chamber 87 and the resilient member chamber 84 may be sufficient to overcome the biasing force of the resilient member 82 for causing movement of the valve element 80 into the second position in which all of the hydraulic fluid returning from the rod ends 56 via the second port 75 is diverted to the third port 76 and on to the cap ends 54 of the cylinders 32*a*, 32*b*. Further, as disclosed earlier herein, the valve element 80 also defines the flow slot 94 to allow fluid to flow from the second port 75 to the third port 76 when the valve element 80 is in the second position.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fill within the scope of the present disclosure as determined based upon the claims and any equivalents thereof.

What is claimed is:

1. A regeneration valve for a hydraulic circuit having a hydraulic fluid flowing therethrough, the regeneration valve comprising:

a housing defining a first port, a second port, and a third port;

a chamber formed in the housing and fluidly communicating with the first, second, and third ports;

a valve element disposed in the chamber and movable between a first position, in which the second port fluidly communicates with the first port, and a second position, in which the second port fluidly communicates with the third port;

a resilient member coupled to the valve element and configured to apply a biasing force on the valve element toward the first position;

a moveable flow restrictor element disposed between the valve element and the housing, the flow restrictor element configured to move between the first port and the second port of the housing for restricting flow of hydraulic fluid from the second port to the first port; and an actuation chamber located at an end of the valve element in a direction opposite to the resilient member, the actuation chamber disposed in selective fluid communication with the second port via a pilot passageway defined in the housing, wherein:

upon restricting flow of fluid from the second port to the first port by the flow restrictor element and at a predetermined flow rate between the second port and the first port, if a supply pressure of hydraulic fluid at the actuation chamber exceeds the biasing force of the resilient member, the valve element moves to the second position for supplying fluid from the second port to the third port.

2. The regeneration valve of claim 1, wherein the valve element further defines a groove configured to bear a retaining ring therein so that when the rate of fluid flow from the second port to the first port is greater than, or equal to, the predetermined fluid flow rate, the flow restrictor element moves to abut with the retaining ring causing a pressure differential between the actuation chamber and a resilient member chamber at opposite ends of the valve element to move the valve element from the first position to the second position when the supply pressure of hydraulic fluid at the actuation chamber exceeds the biasing force of the resilient member.

3. The regeneration valve of claim 1, wherein the biasing force of the resilient member is adjustable to achieve the predetermined flow rate of hydraulic fluid from the second port to the first port so that the moveable flow restrictor moves between the first port and the second port of the housing for restricting flow of hydraulic fluid from the second port to the first port.

4. The regeneration valve of claim 1, wherein the valve element includes a land.

5. The regeneration valve of claim 4, wherein when the valve element is moved into the second position, the land is configured to block flow of hydraulic fluid from the second port to the first port.

6. The regeneration valve of claim 1, wherein the resilient member is disposed at one end of the valve element and located adjacent to the moveable flow restrictor element.

7. The regeneration valve of claim 1, wherein a flow slot is formed in the valve element.

8. The regeneration valve of claim 7, wherein the flow slot is located adjacent to a land and disposed away from the resilient member.

9. The regeneration valve of claim 1, wherein the housing defines a resilient member chamber configured to receive the resilient member therein.

10. The regeneration valve of claim 1, wherein the moveable flow restrictor element is shaped as a sleeve and disposed about the valve element.

11. The regeneration valve of claim 1, wherein the hydraulic circuit includes a hydraulic cylinder having a cylinder rod end and a cylinder cap end, and wherein the first port fluidly communicates with a fluid reservoir, the second port fluidly communicates with the cylinder rod end, and the third port fluidly communicates with the cylinder cap end.

12. A hydraulic circuit for a machine implement, the hydraulic circuit comprising:

a pressurized hydraulic fluid source;

a fluid reservoir;

a hydraulic cylinder having a cylinder cap end and a cylinder rod end;

a regeneration valve including:

a housing defining a first port fluidly communicating with the fluid reservoir, a second port fluidly communicating with the cylinder rod end, and a third port fluidly communicating with both the pressurized fluid source and the cylinder cap end;

a chamber formed in the housing and fluidly communicating with the first, second, and third ports;

a valve element disposed in the chamber and movable between a first position, in which the second port fluidly communicates with the first port, and a second position, in which the second port fluidly communicates with the third port;

a resilient member coupled to the valve element and configured to apply a biasing force on the valve element toward the first position; and a moveable flow restrictor element disposed between the valve element and the housing, the flow restrictor element configured to move between the first port and the second port of the housing for restricting flow of hydraulic fluid from the second port to the first port; and an actuation chamber located at an end of the valve element in a direction opposite to the resilient member, the actuation chamber disposed in selective fluid communication with the second port via a pilot passageway defined in the housing, wherein:

upon restricting flow of fluid from the second port to the first port by the flow restrictor element and at a predetermined flow rate between the second port to the first port, if a supply pressure of hydraulic fluid at the actuation chamber exceeds the biasing force of the resilient member, the valve element moves to the second position for supplying fluid from the second port to the third port.

13. The hydraulic circuit of claim 12, wherein the valve element further defines a groove configured to bear a retaining ring therein so that when the rate of fluid flow from the second port to the first port is greater than, or equal to, the predetermined fluid flow rate, the flow restrictor element moves to abut with the retaining ring causing a pressure differential between the actuation chamber and a resilient member chamber at opposite ends of the valve element to move the valve element from the first position to the second position when the supply pressure of hydraulic fluid at the actuation chamber exceeds the biasing force of the resilient member.

14. The hydraulic circuit of claim 12, wherein the biasing force of the resilient member is adjustable to achieve the predetermined flow rate of hydraulic fluid from the second port to the first port so that the moveable flow restrictor moves between the first port and the second port of the housing for restricting flow of hydraulic fluid from the second port to the first port.

15. The hydraulic circuit of claim 12, wherein the valve element includes a land such that when the valve element is moved into the second position, the land is configured to block flow of hydraulic fluid from the second port to the first port.

16. The hydraulic circuit of claim 12, wherein the resilient member is disposed at one end of the valve element and located adjacent to the moveable flow restrictor element.

17. The hydraulic circuit of claim 12, wherein a flow slot is formed in the valve element.

18. The hydraulic circuit of claim 17, wherein the flow slot is located adjacent to a land and disposed away from the resilient member.

19. The hydraulic circuit of claim 12, wherein the housing defines a resilient member chamber configured to receive the resilient member therein.

20. The hydraulic circuit of claim 12, wherein the moveable flow restrictor element is shaped as a sleeve and disposed about the valve element.

* * * * *